US012268917B2

(12) United States Patent
Fletcher

(10) Patent No.: US 12,268,917 B2
(45) Date of Patent: Apr. 8, 2025

(54) FITNESS ROPE APPARATUS WITH PLURALITY OF FIXED STOPPERS

(71) Applicant: Walter Fletcher, Fort Lauderdale, FL (US)

(72) Inventor: Walter Fletcher, Fort Lauderdale, FL (US)

( * ) Notice: Subject to any disclaimer, the term of this patent is extended or adjusted under 35 U.S.C. 154(b) by 135 days.

(21) Appl. No.: 17/719,651

(22) Filed: Apr. 13, 2022

(65) Prior Publication Data

US 2023/0330473 A1 Oct. 19, 2023

(51) Int. Cl.
*A63B 21/00* (2006.01)

(52) U.S. Cl.
CPC ..... *A63B 21/151* (2013.01); *A63B 21/4035* (2015.10)

(58) Field of Classification Search
CPC ... A63B 21/002; A63B 2023/006; A63B 7/04; E06C 9/14
See application file for complete search history.

(56) References Cited

U.S. PATENT DOCUMENTS 285,806 A * 10/1883 Foster ..... D07B 1/02 403/209
1,765,361 A * 6/1930 Berman ..... A63B 9/00 D21/826
3,294,196 A * 12/1966 Rabelos ..... E06C 9/14 182/100
3,642,277 A * 2/1972 Gersten ..... A63B 7/04 482/37
3,643,947 A * 2/1972 Collins ..... A63F 9/00 473/576
4,161,998 A * 7/1979 Trimble ..... E06C 1/56 482/37
5,341,758 A * 8/1994 Strickland ..... B63B 34/60 87/6
5,743,354 A * 4/1998 Hunter ..... A62B 1/18 182/100
5,944,640 A * 8/1999 Larsson ..... A63B 21/4035 482/141

(Continued)

OTHER PUBLICATIONS

5 Ways to Stop Rope From Fraying: "https://www.ropesdirect.co.uk/blog/5-ways-to-stop-rope-from-fraying/" Sep. 21, 2021 (Year: 2021).*

(Continued)

*Primary Examiner* — Nyca T Nguyen
(74) *Attorney, Agent, or Firm* — The Keys Law Firm PLLC

(57) ABSTRACT

A fitness rope apparatus which includes an elongated rope body having a plurality of stopper members fixed thereon along its length and a distal end having an eye splice which forms a permanent loop. The plurality of stopper members are evenly spaced out along the length of the rope body, with each individually coupled to the rope by way of a securing member. In addition, each of the stopper members is a spherical exterior surface which provides a thicker portion relative to the rope body while not including any sharp corners or edges. In this regard, the stopper members each provide a discrete point of leverage for a user desiring to grasp the fitness rope apparatus which, in the event the user's grip weakens, does not present a surface on which a finger can get stuck or that can otherwise easily cause injury.

19 Claims, 5 Drawing Sheets

(56) References Cited

U.S. PATENT DOCUMENTS 5,993,377 A * 11/1999 Hartwig ..... A61F 7/12 600/38
6,402,670 B1 * 6/2002 Anagnostou ..... A63B 21/068 482/148
6,723,031 B1 * 4/2004 Wild ..... A63B 23/20 600/38
7,703,372 B1 * 4/2010 Shakespeare ..... D07B 1/04 87/13
8,157,712 B1 * 4/2012 Musachio ..... A63B 21/4034 482/121
D682,968 S * 5/2013 Adinolfe, Sr. ..... D21/810
8,715,140 B1 * 5/2014 Gertz ..... A63B 9/00 482/90
8,794,702 B2 * 8/2014 Brown ..... A63G 1/16 472/121
10,159,314 B2 * 12/2018 Kirth ..... D03D 15/46
10,286,251 B2 * 5/2019 Watry ..... A63B 21/4033
D895,340 S * 9/2020 Sabbagh ..... D6/718.1
10,918,194 B2 * 2/2021 Conlin ..... D05B 93/00
D941,949 S * 1/2022 Zheng ..... D21/826
11,529,536 B1 * 12/2022 Ferreira ..... A63G 31/00
2002/0022555 A1 * 2/2002 Nesci ..... A63B 21/0552 482/139
2005/0247521 A1 * 11/2005 Diggle ..... A63B 27/00 182/133
2008/0000572 A1 * 1/2008 Lopez ..... G09F 3/0295 428/34.9
2011/0212813 A1 * 9/2011 Weber ..... A61H 1/02 482/131
2014/0179499 A1 * 6/2014 Weber ..... A61H 1/0274 482/131
2016/0287921 A1 * 10/2016 Bonham ..... A63B 7/02
2016/0287927 A1 * 10/2016 Hunter ..... A63B 21/0552
2017/0001055 A1 * 1/2017 Brown ..... A63B 7/04
2019/0060696 A1 * 2/2019 Moore ..... A63B 23/0488
2019/0262649 A1 * 8/2019 Wymer ..... A63B 7/04
2019/0388722 A1 * 12/2019 Townsend ..... A63B 21/151
2021/0086014 A1 * 3/2021 Sharp ..... A63B 21/151
2022/0080252 A1 * 3/2022 Sharp ..... A63G 9/12

OTHER PUBLICATIONS

Amazon BuyHeatShrink 2 INCH Heat Shrink END Cap "https://www.amazon.com/BuyHeatShrink-INCH-Heat-Shrink-Rope/dp/B00FDVE3GI" Sep. 19, 2020 (Year: 2020).*

* cited by examiner

FITNESS ROPE APPARATUS WITH PLURALITY OF FIXED STOPPERS

BACKGROUND OF THE INVENTION

Field of the Invention

This invention relates generally to a fitness tool and, more particularly, to a rope apparatus with plurality of fixed stoppers for use during physical exercise.

Description of the Prior Art

The general design of a rope, typically defined by a group of elongated fibrous items which have been twisted or braided together, is well known. While many uses for ropes have been established over the years, one common contemporary use of ropes is for providing assistance during the performance of various exercises or other physical fitness promoting movements. Ropes which are suitable for such fitness activities can be constructed of various materials and in various styles and lengths, and also may include various types of end sections or more handling sections. But regardless of the design particulars, the rope in general is well established as very versatile fitness tool; one that can be used in connection with many different types of activities, including jumping, climbing, lifting, pulling, and swinging.

A limitation which still exists, however, is that for common rope designs, their elongated structure and substantially uniform thickness often makes it difficult for one to grasp and hold in a specific desired location without slipping if one is exerting substantial pulling force on the rope (or if the rope itself is subject to such forces). In addition, many rope designs lack any mechanism which allows the rope to be quickly and securely (i.e., without the loss of tensile strength that comes from using a knot), but temporarily, attached to a discrete structure. As a result of these limitations, some rope designs are often less useful for one desiring to perform certain stretching exercises or movements performed while hanging upside down.

Thus, there remains a need for a fitness rope apparatus which includes a plurality of fixed stoppers spaced out throughout its length which each provide a rigid integral gripping element which is thicker than rope body of the apparatus but has a smooth surface that will not be prone to getting one's finger snagged on it. It would additionally be desirable for such a fitness rope apparatus with plurality of fixed stoppers to include an integrated loop at one end which can allow the fitness rope apparatus to be securely but removably affixed vertical or horizontal supports.

SUMMARY OF THE INVENTION

The present disclosure provides for a fitness rope apparatus, comprising: an elongated rope body having a defined rope thickness and an exterior surface in addition to having a proximal end and a distal end; a loop portion integral with the elongated rope body, wherein the distal end of the elongated rope body is defined by the loop portion; a cover element defined by end tubing which is integral with the elongated rope body, wherein the cover element is fixedly positioned at the proximal end of the elongated rope body; and a plurality of stopper members which are each separately integral with the elongated rope body at a discrete, fixed location on the elongated rope body that is between the loop portion and the cover element, wherein each of the plurality of stopper members has a smooth exterior surface as well as a stopper thickness which at its greatest point exceeds the rope thickness.

It is an object of the present disclosure to provide a fitness rope apparatus which includes plurality of fixed stoppers spaced out throughout its length which each provide a rigid integral gripping element which is thicker than rope body of the apparatus but has a smooth surface.

It is an additional object of the present disclosure to provide a fitness rope apparatus with plurality of fixed stoppers which includes an integrated loop at one end which can allow the fitness rope apparatus to be securely but removably affixed vertical or horizontal supports.

DETAILED DESCRIPTION OF THE INVENTION

Figure 1:
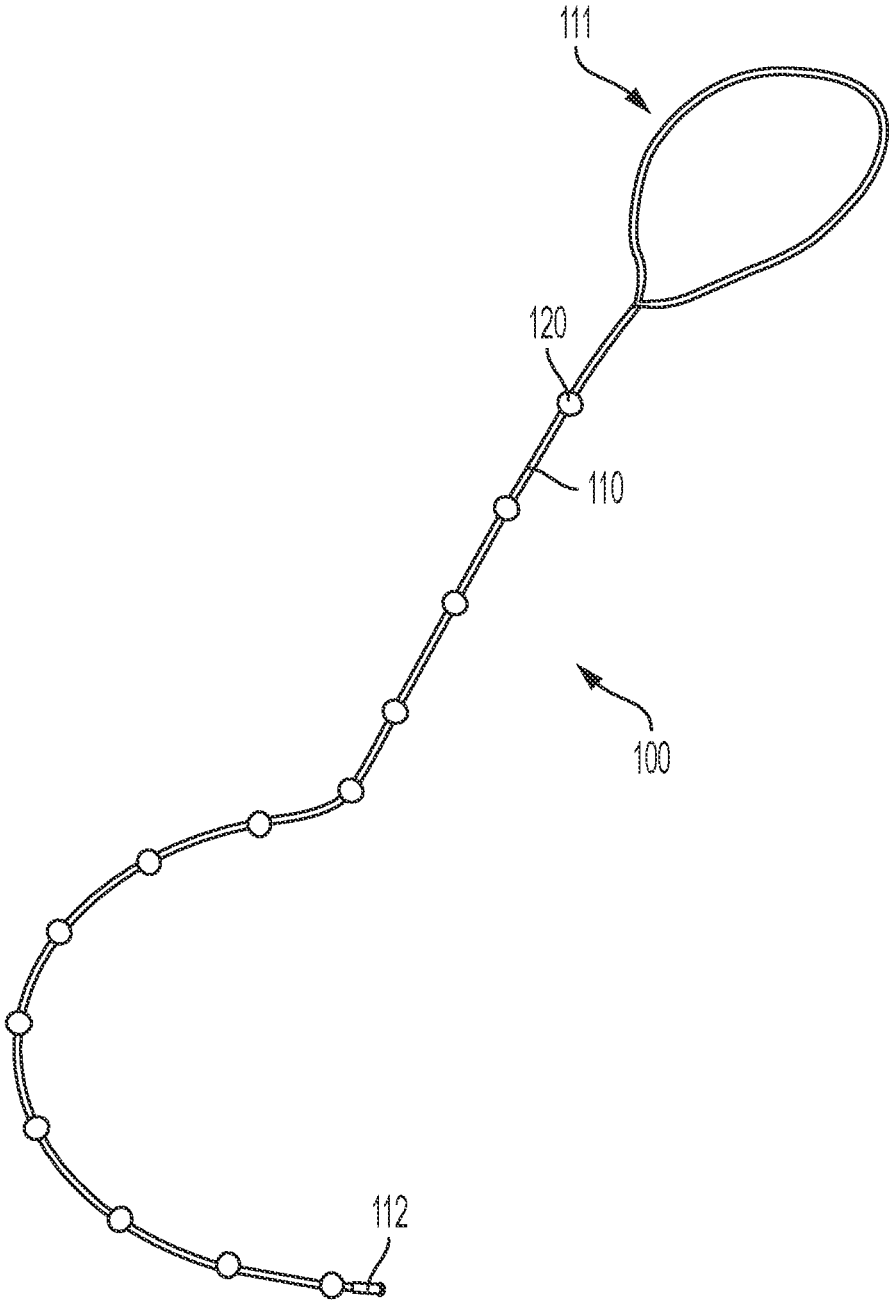
FIG. 1 is a top plan view of a fitness rope apparatus with plurality of fixed stoppers built in accordance with the present invention.

Described herein is a fitness rope apparatus which includes an elongated rope body having a plurality of stopper members fixed thereon along its length and a distal end having an eye splice which forms a permanent loop. The plurality of stopper members are evenly spaced out along the length of the rope body, with each individually coupled to the rope by way of a securing member. In addition, each of the stopper members is a spherical exterior surface which provides a thicker portion relative to the rope body while not including any sharp corners or edges. In this regard, the stopper members each provide a discrete point of leverage for a user desiring to grasp the fitness rope apparatus which, in the event the user's grip weakens, does not present a surface on which a finger can get stuck or that can otherwise easily cause injury.

Referring now to the drawings and, in particular, FIGS. 1, 2A, 2B, 3A, 3B, 4, 5, 6, and 7, a fitness rope apparatus 100 may be formed from an elongated rope body 110 having a proximal end and a distal end and a plurality of stopper members 120 which are fixed in discrete locations to the rope body 110. The rope body 110 may be constructed as a 4 mm double braided Class I polyester rope and may measure eight (8) feet from end to end. It is contemplated, however, that alternate sizes, classes, and materials may be used to form the rope body 110, and it may be made in alternate lengths.

The distal end of the rope body may be defined by a loop portion 111. The loop portion 111 may be formed as a 12-inch eye splice. It is contemplated, however, that the opening of the loop portion may be of alternate sizes, provided that that the loop portion 111 does not extend to where any stopper member 120 is attached to the rope body 110.

Figure 2B:
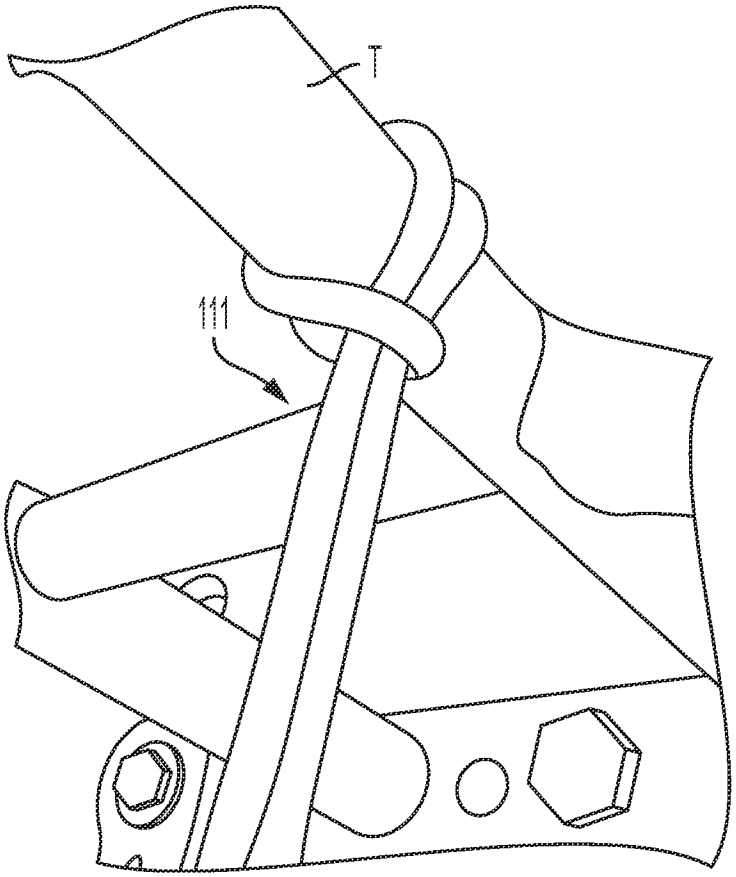
FIG. 2B is a top plan view of a fitness rope apparatus with plurality of fixed stoppers built in accordance with the present invention, showing the distal end in a secured configuration.
Figure 2A:
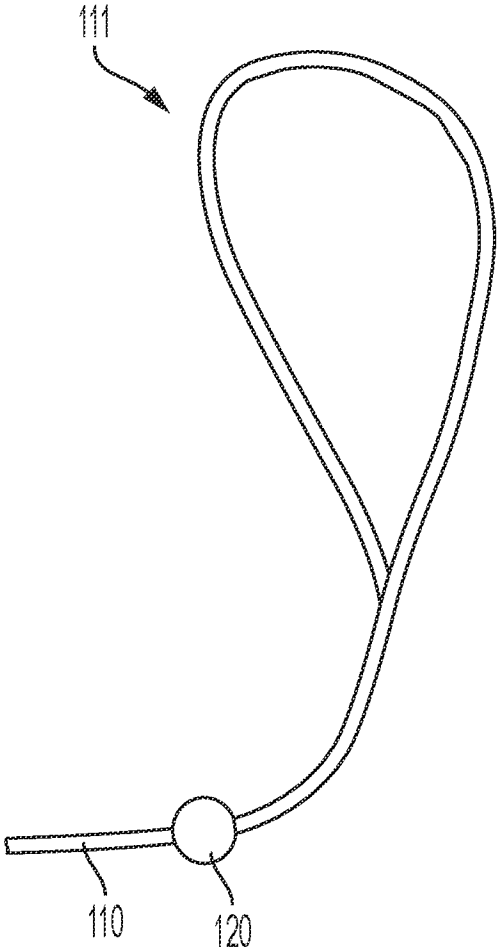
FIG. 2A is a top plan view of a fitness rope apparatus with plurality of fixed stoppers built in accordance with the present invention, showing the distal end in an open configuration.
Figure 3A:
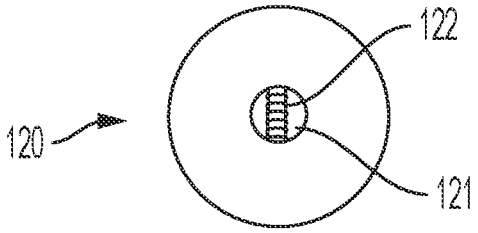
FIG. 3A is top plan view of a stopper of a fitness rope apparatus with plurality of fixed stoppers built in accordance with the present invention.
Figure 3B:
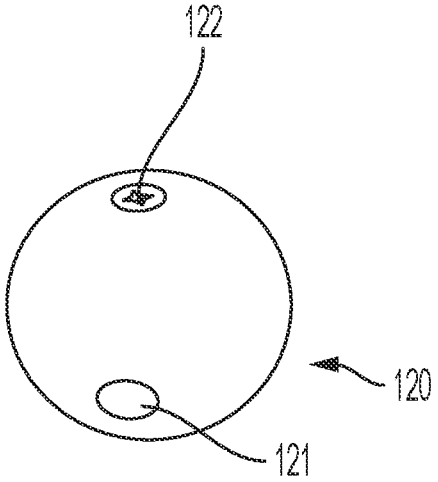
FIG. 3B is top perspective view of a stopper member of a fitness rope apparatus with plurality of fixed stoppers built in accordance with the present invention.
Figure 4:
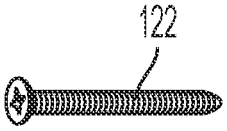
FIG. 4 is a top plan view of the securing member for a stopper of a fitness rope apparatus with plurality of fixed stoppers built in accordance with the present invention.
Figure 5:
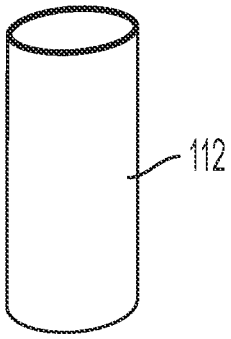
FIG. 5 is a side perspective view of proximal end tubing of a fitness rope apparatus with plurality of fixed stoppers built in accordance with the present invention.
Figure 6:
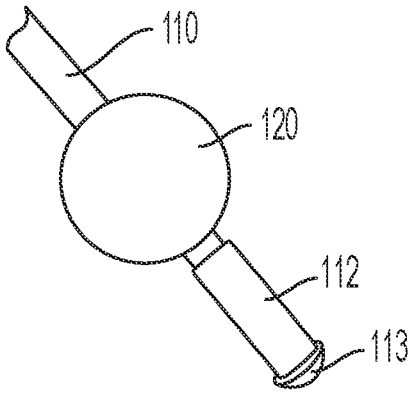
FIG. 6 is a top plan view of a fitness rope apparatus with plurality of fixed stoppers built in accordance with the present invention, showing the proximal end.
Figure 7:
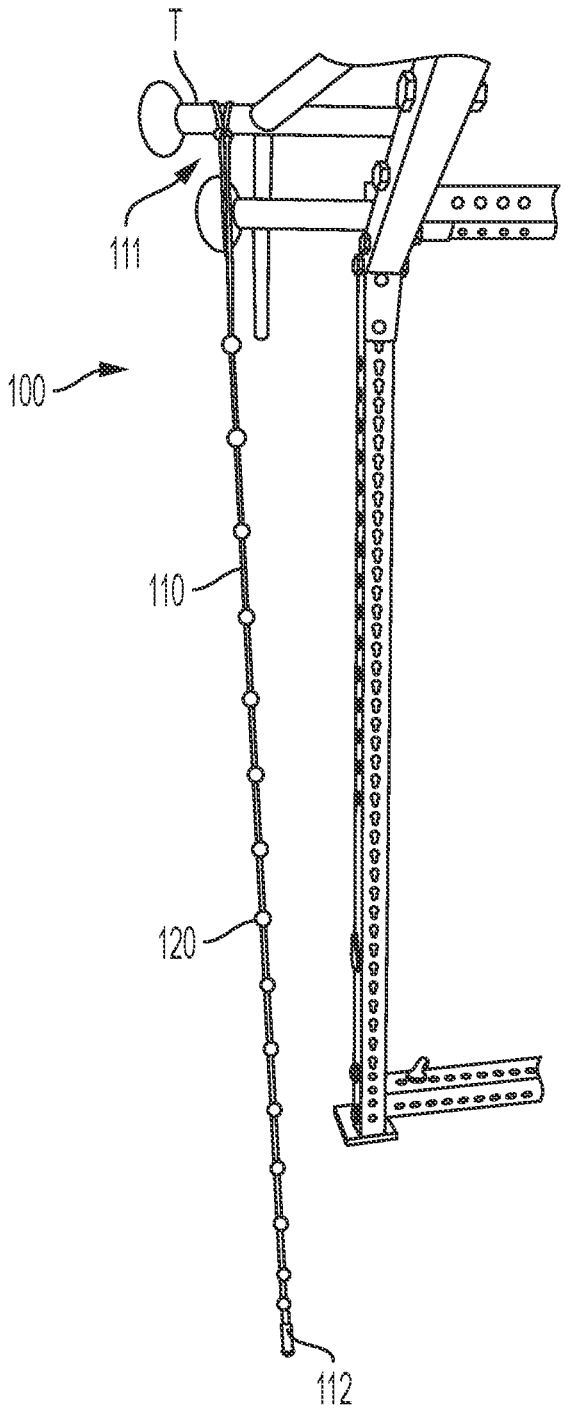
FIG. 7 is an elevational view of a fitness rope apparatus with plurality of fixed stoppers built in accordance with the present invention, shown attached to a horizontal support bar.

The loop portion 111 enables the fitness rope apparatus 100 to be attached to many types of securely affixed vertical or horizontal supports, such as pull-up bars, sturdy tree limbs, or columns, all without requiring a knot to be tied in the rope body 110. When the loop portion 111 is in its open configuration, as illustrated in FIG. 2A, it can be looped around a target support T and the distal end and remaining parts of the rope body 110 can be passed through the opening of the loop portion 111, leaving the loop portion 111 in the secured configuration, as shown in FIG. 2B. When the loop portion 111 is in its secured configuration around the target support T, the fitness rope apparatus 100 is secured to the target support T.

The proximal end of the rope body 110 may include a cover element, which may be defined by a length of end tubing 112 which has been permanently coupled with the rope body 110 and an end portion 113 which defines the terminal aspect of the proximal end of the rope body 110 and may include a part which is bulging such that it is sized to protrude outwardly beyond the width of the end tubing 112 so as to have at its greatest point a transverse thickness that exceeds a transverse thickness of the end tubing 112. This end tubing 112 may extend over the rope body longitudinally, starting next to the end portion 113 and moving towards the distal end of the rope body 110. The end tubing 112 may be defined as a one (1) inch long portion of heat shrink tubing which has been placed over the rope body 110 and then heated to shrink and wrap tightly around the rope body 110, thereby coupling the end tubing 112 thereto to the rope body 110. The end tubing 112 may additionally include an adhesive material disposed on its interior surface to help provide a good seal and better adhesion to the rope body 110. It is contemplated, however, that the end tubing 112 may be longer or shorter than one (1) inch, provided that the end tubing 112 does not contact any stopper member 120 which is attached to the rope body 110 when the rope body 110 is held straight.

Each of the stopper members 120 may be defined as a substantially rigid spherical body which may be 1.088 inches in diameter and constructed of high impact plastic that is ultraviolet resistant. It is contemplated, however, that the stopper members 120 may be larger or smaller than 1.088 inches and may be formed of another rigid material.

The stopper members 120 may include a central aperture 121 which passes through it and which enables the rope body 110 to pass through each of the stopper members 120. When the rope body 110 is passed through the central aperture 121 of a given stopper member 120, the given stopper member 120 may be fixed to the rope body 110 with a securing member 122. The securing member may be defined as an elongated mechanical fastener, such as a #4×1" stainless steel flat-head tapping screw. The securing member 122 may be passed through the stopper member 120 such that it is orthogonal to the central aperture 121 and goes through the central aperture 121 at (or substantially at) the center of the stopper member 120. In this regard, the securing member 122 will also pass through the rope body 110 which is passing through the central aperture 121, thereby fastening the stopper member 120 to the rope body 110 at the specific location along the length of the rope body 110 where the stopper member 120 was when the securing member 122 was passed through it.

It is contemplated that the securing member 122 may be defined by a different size or style elongated mechanical fastener, except that the securing member 122 must be inserted so that its head is flush with the exterior surface of the stopper member 120 and must able to pass from the exterior surface of the stopper member 120 through its central aperture 121, without extending beyond the surface of the opposite side of the stopper member 120 from which it entered. It is further contemplated that the securing member 122 may be inserted into a predrilled hole or be self-tapping.

The plurality of stopper members 120 may be permanently affixed to the rope body 110 and evenly spaced from one another. The stopper member 120 closest to the distal end may be located 6.5 inches from the base of the loop portion 111. From there, a stopper member 120 may be positioned along the rope body 110 at every 5 inches, 5.5 inches, 6 inches, 6.5 inches, 7 inches, or 7.5 inches, measured center to center of each stopper member 120. The specific distance between all the stopper members 120 for a given fitness rope apparatus 100 may depending on a user's hand width and preference. That said, it is appreciated that for a given fitness rope apparatus 100, all of the stopper members 120 will have the same spacing relative to one another.

Depending on the specific spacing used for the stopper members 120 of a given fitness rope apparatus 100, the number of stopper members 120 being used may change. For example, if the stopper members 120 are at every 5 inches, 16 stopper members 120 may be used. If the stopper members 120 are at every 5.5 inches, 15 stopper members 120 may be used. If the stopper members 120 are at every 6 inches, 14 stopper members 120 may be used. If the stopper members 120 are at every 6.5 inches, 13 stopper members 120 may be used. If the stopper members 120 are at every 7 inches, 12 stopper members 120 may be used. If the stopper members 120 are at every 7.5 inches, 11 stopper members 120 may be used. Nonetheless, it is contemplated that the fitness rope apparatus 100 may include an alternate number of stopper members 120, space at alternate intervals.

Figure 8:
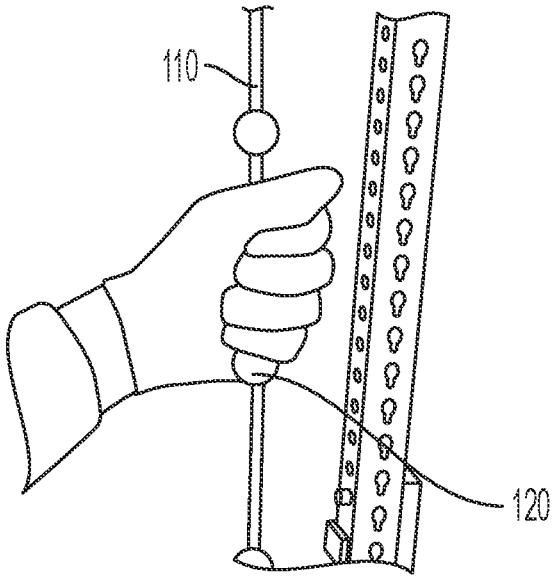
FIG. 8 is a partial side elevational view of a fitness rope apparatus with plurality of fixed stoppers built in accordance with the present invention, being grasped by a user.
Figure 9:
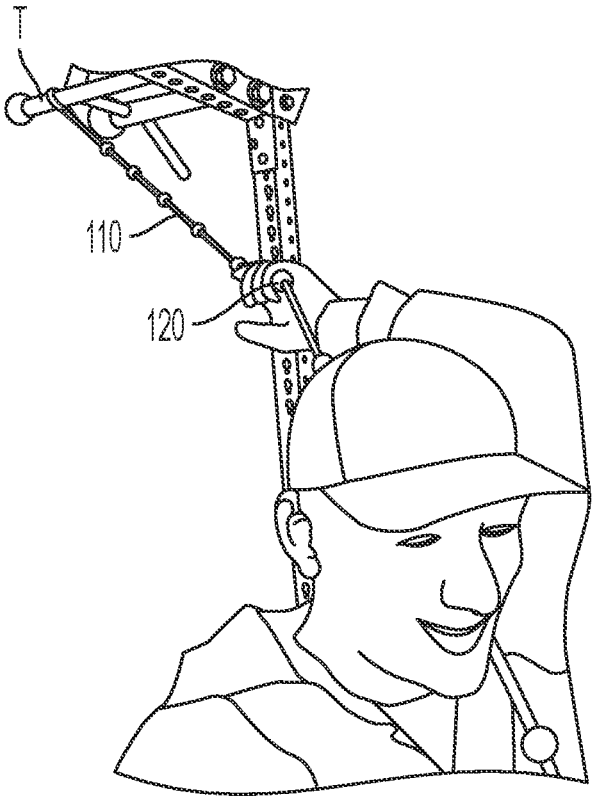
FIG. 9 is a top plan view of a fitness rope apparatus with plurality of fixed stoppers built in accordance with the present invention, shown attached to a horizontal support bar and being pulled by a user.

Referring now to FIGS. 8, and 9, in use, the fitness rope apparatus 100 may be grasped by a user's hand on its rope body 110, adjacent to one of the stopper members 120. In this regard, when the user pulls on the rope body 110, the stopper member 120 adjacent to their hand provides a point of leverage and greatly reduces the likelihood of the user's hand slipping. This allows for the performance of various stretches and exercises, including allowing a user to position themselves for inverted exercises (and also later get out of positions for doing inverted exercises).

That said, the spherical nature of the stopper members 120 means that if the user's hand does slip, it can simply pass over the smooth contour of the stopper member's 120 exterior surface and will not get snagged or cut by an abutting edge or corner. As such, the fitness rope apparatus 100 provides for improved gripping functionality without substantially increasing the risk of a user getting their finger or hand caught in an undesirable position.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A fitness rope apparatus, comprising:

an elongated rope body having a defined rope thickness and an exterior surface in addition to having a proximal end and a distal end;

a loop portion integral with the elongated rope body, wherein the distal end of the elongated rope body is defined by the loop portion;

an end portion integral with the elongated rope body, wherein the end portion forms a terminal aspect of the proximal end of the rope body;

a cover element integral with the elongated rope body and having a defined cover thickness, wherein the cover element is defined by a tube which is attached to and is wrapped tightly around the elongated rope body, extending over the elongated rope body longitudinally starting next to the end portion and moving towards the distal end;

wherein the end portion has an end thickness which at its greatest point exceeds the cover thickness;

a plurality of stopper members which are each separately integral with the elongated rope body at a discrete, fixed location on the elongated rope body that is between the loop portion and the cover element, wherein each of the plurality of stopper members has a smooth exterior surface as well as a stopper thickness which at its greatest point exceeds the rope thickness; and wherein the plurality of stopper members and the cover element are relatively positioned such that the cover element does not contact any of the plurality of stopper members when the elongated rope body is held straight.

2. The fitness rope of claim 1, wherein the plurality of stopper members are each defined by a discrete spherical body which is rigid and configured to surround at least a portion of the exterior surface of the elongated rope body.

3. The fitness rope of claim 2, additionally comprising a discrete securing member which corresponds to one of each of the plurality of stopper members and is positioned to pass through both the stopper member to which the securing member corresponds and the rope body.

4. The fitness rope of claim 2, wherein the stopper thickness, which for each of the plurality of stopper members is defined by its diameter, is at least six times the rope thickness.

5. The fitness rope of claim 2, wherein each of the plurality of stopper members is identical in size and shape.

6. The fitness rope of claim 2, wherein the plurality of stopper members are situated on the rope body sequentially and evenly spaced apart on the rope body.

7. The fitness rope of claim 1, wherein the cover element defined by a heat shrink tube.

8. The fitness rope of claim 1, wherein the cover element additionally includes an adhesive disposed on a surface which contacts the elongated rope body to which the cover element is attached to enhance the seal and attachment of the cover element to the elongated rope body.

9. The fitness rope of claim 1, wherein the rope body is defined by a polyester double braided rope.

10. The fitness rope of claim 1, wherein the loop portion is defined as an eye splice in the rope body.

11. A fitness rope apparatus, comprising:

an elongated rope body having a defined rope thickness and an exterior surface in addition to having a proximal end and a distal end;

a loop portion integral with the elongated rope body and defined as an eye splice in the rope body, wherein the distal end of the elongated rope body is defined by the loop portion;

an end portion integral with the elongated rope body, wherein the end portion forms a terminal aspect of the proximal end of the rope body;

a cover element integral with the elongated rope body and having a defined cover thickness, wherein the cover element is defined by a heat shrink tube which is attached to and is wrapped tightly around the elongated rope body, extending over the elongated rope body longitudinally starting next to the end portion and moving towards the distal end;

wherein the cover element additionally includes an adhesive disposed on a surface which contacts the elongated rope body to which the cover element is attached to enhance the seal and attachment of the cover element to the elongated rope body;

wherein the end portion has an end thickness which at its greatest point exceeds the cover thickness;

a plurality of stopper members which are each separately coupled with the elongated rope body at a discrete, fixed location on the elongated rope body that is between the loop portion and the cover element and configured to surround at least a portion of the exterior surface of the elongated rope body;

wherein each of the plurality of stopper members are defined by a discrete spherical body which is rigid and has a smooth exterior surface as well as a stopper thickness which at its greatest point exceeds the rope thickness; and wherein the plurality of stopper members and the cover element are relatively positioned such that the cover element does not contact any of the plurality of stopper members when the elongated rope body is held straight.

12. The fitness rope of claim 11, additionally comprising a discrete securing member which corresponds to one of each of the plurality of stopper members and is positioned to pass through both the stopper member to which the securing member corresponds and the rope body.

13. The fitness rope of claim 11, wherein the stopper thickness, which for each of the plurality of stopper members is defined by its diameter, is at least six times the rope thickness.

14. The fitness rope of claim 11, wherein each of the plurality of stopper members is identical in size and shape.

15. The fitness rope of claim 11, wherein the plurality of stopper members are situated on the rope body sequentially and evenly spaced apart on the rope body.

16. The fitness rope of claim 11, wherein the rope body is defined by a double braided rope.

17. The fitness rope of claim 11, wherein the rope body is defined by a double braided polyester rope.

18. A fitness rope apparatus, comprising:

an elongated rope body having a defined rope thickness and an exterior surface in addition to having a proximal end and a distal end, wherein the elongated rope body is defined by a double braided polyester rope;

a loop portion integral with the elongated rope body and defined as an eye splice in the rope body, wherein the distal end of the elongated rope body is defined by the loop portion;

an end portion integral with the elongated rope body, wherein the end portion forms a terminal aspect of the proximal end of the rope body;

a cover element integral with the elongated rope body and having a defined cover thickness, wherein the cover element is defined by a heat shrink tube which is attached to and is wrapped tightly around the elongated rope body, extending over the elongated rope body longitudinally starting next to the end portion and moving towards the distal end;

wherein the end portion has an end thickness which at its greatest point exceeds the cover thickness;

wherein the cover element additionally includes an adhesive disposed on a surface which contacts the elongated rope body to which the cover element is attached to enhance the seal and attachment of the cover element to the elongated rope body;

a plurality of stopper members which are each separately coupled with the elongated rope body at a discrete, fixed location on the elongated rope body that is between the loop portion and the cover element and configured to surround at least a portion of the exterior surface of the elongated rope body;

wherein each of the plurality of stopper members are defined by a discrete spherical body which is rigid and has a smooth exterior surface as well as a stopper thickness which at its greatest point exceeds the rope thickness;

wherein each of the plurality of stopper members is identical in size and shape and the plurality of stopper members are situated on the rope body sequentially as well as evenly spaced apart on the rope body;

a discrete securing member which corresponds to one of each of the plurality of stopper members and is positioned to pass through both the stopper member to which the securing member corresponds and the rope body; and wherein the plurality of stopper members and the cover element are relatively positioned such that the cover element does not contact any of the plurality of stopper members when the elongated rope body is held straight.

19. The fitness rope of claim 18, wherein the stopper thickness, which for each of the plurality of stopper members is defined by its diameter, is at least six times the rope thickness.

* * * * *